United States Patent [19]

Faber et al.

[11] 4,204,737

[45] May 27, 1980

[54] SUBSTRATE STRAIGHTENING ADAPTOR FOR ELECTRICAL CONNECTOR ASSEMBLY

[75] Inventors: Edward S. Faber, Atkinson, N.H.; John J. Hovan, Groveland; Walter J. Sinsheimer, North Andover, both of Mass.

[73] Assignee: Western Electric Company, Inc., New York, N.Y.

[21] Appl. No.: 873,820

[22] Filed: Jan. 31, 1978

[51] Int. Cl.[2] ..... H01R 13/20

[52] U.S. Cl. ..... 339/65; 339/75 MP; 339/176 MP

[58] Field of Search ..... 339/65, 66 R, 66 M, 339/17 L, 75 MP, 176 MP

[56] References Cited

U.S. PATENT DOCUMENTS

| | | | |
|---|---|---|---|
| 3,314,040 | 4/1967 | McKee | 339/176 MP |
| 3,329,926 | 7/1967 | Aksu et al. | 339/75 MP |
| 3,395,377 | 7/1968 | Straus | 339/17 L |
| 3,526,869 | 9/1970 | Conrad et al. | 339/176 MP |
| 3,692,966 | 9/1972 | Lancaster | 339/176 MP |
| 4,021,091 | 5/1977 | Anhalt et al. | 339/75 MP |

OTHER PUBLICATIONS

IBM Technical Bulletin, vol. 17, No. 1, Jun. 1974, p. 128.

*Primary Examiner*—Paul A. Bell
*Attorney, Agent, or Firm*—D. D. Bosben

[57] ABSTRACT

A molded plastic adapter (10) for an electrical connector assembly (14) includes a rectangular first slot (26) for receiving a terminal support block (12) having electrical terminals (18) mounted therein. Guide portions (30) of the assembled adaptor (10) then overlie portions of the support block (12) and portions of the terminals (18) in protective relationship and are spaced apart to define a rectangular substrate-receiving second slot (32). The guide portions (30) straighten a warped leading edge (16e) of a substrate (16) as the substrate is inserted between the guide portions into the terminals (18) to preclude breakage of the support block (12) and/or bending of the terminals by the warped leading edge. The initial spacing between opposed resilient side walls (22) of the adapter (10) intermediate their ends is reduced so that the side walls produce a friction fit with the support block (12) when the adaptor is assembled to the support block.

2 Claims, 5 Drawing Figures

SUBSTRATE STRAIGHTENING ADAPTOR FOR ELECTRICAL CONNECTOR ASSEMBLY

FIELD OF THE INVENTION

This invention relates to a substrate straightening adaptor for an electrical connector assembly, and more specifically to an adaptor which can readily be mounted on a terminal support block of an electrical connector assembly for straightening a warped leading edge of a substrate (printed wiring board) as the substrate is inserted through the adaptor into engagement with terminals mounted in the support block.

DESCRIPTION OF THE PRIOR ART

In the insertion of a substrate, such as a printed wiring board, into a terminal support block of certain types of electrical connector assemblies which have been mounted in associated electrical apparatus, difficulty often is encountered in the insertion process as a result of the printed wiring board having a warped leading edge. Under such conditions, any attempt to insert the warped printed wiring board into the terminal support block frequently results in breakage of the support block and/or bending of terminals mounted in the support block.

It then may be necessary to disconnect the damaged electrical connector assembly from the apparatus, replace the damaged electrical connector assembly with a new electrical connector assembly, and then rewire the new electrical connector assembly into the apparatus. This is particularly disadvantageous where the apparatus is already installed in the field, since it requires that the apparatus be taken out of service. It also may be necessary to discard the warped printed wiring board and the associated electrical components which normally are mounted thereon, as being unusable.

In the past, stiffener ribs have been utilized in printed wiring boards in an attempt to preclude warping of the boards. These stiffener ribs are undesirable, however, since their inclusion in a printed wiring board increases its cost and produces a heavy cumbersome product.

Attempts also have been made to glue guide members to the opposite sides of a terminal support block for the purpose of straightening a warped leading edge of a printed wiring board as the board is inserted into the support block. This approach is undesirable for various reasons, such as the time and effort involved in the attaching of the guide members to the terminal support block. This approach also is generally not practical where the terminal support block is already mounted in apparatus in the field.

The use of molded plastic guide members which attach to opposite ends of a terminal support block in projecting relationship with respect to the support block are shown in the W. R. Mattingly, Jr. et al. U.S. Pat. No. 3,768,066, issued Oct. 23, 1973 and the H. H. Ammenheuser U.S. Pat. No. 3,932,016, issued Jan. 13, 1976. In these patents, however, the guide members receive side edges of a printed wiring board as it is inserted into terminals of the associated terminal support block, rather than receiving a leading edge of a printed wiring board.

SUMMARY OF THE INVENTION

In general, this invention relates to a substrate straightening adaptor for an electrical connector assembly wherein the adaptor includes a pair of opposed side walls and a pair of opposed end walls interconnected to define an elongated essentially rectangular first slot for receiving portions of a terminal support block having electrical terminals mounted therein. Guide portions project inwardly in opposed spaced relationship from the opposed side walls to define an elongated essentially rectangular substrate-receiving second slot which is narrower than the first slot. The guide portions overlie portions of the terminal support block in protective relationship when the adaptor is assembled to the support block and straighten a warped leading edge of a substrate as the substrate is inserted through the narrower second slot into the support block. As a result breakage of the terminal support block and/or bending of the terminals in the support block as a result of the warpage in the substrate, and the need for providing stiffeners in the substrate so as to preclude warpage of the substrate, are eliminated.

More specifically, the substrate straightening adaptor is a molded integral plastic member. The opposed side walls of the adaptor are resilient and the spacing between the side walls intermediate their ends is less than the spacing between the side walls at junctions of the side walls with the adaptor end walls. Thus, when the adaptor is assembled to the terminal support block to provide an electrical connector device, the side walls retain the adaptor on the support block with a friction fit without the need for any auxiliary connecting mechanism (e.g., latches or tabs) on the adaptor or the support block, making the adaptor particularly useful in the field on electrical connector assemblies which are already mounted in position in associated apparatus. The guide portions include surfaces which are tapered outwardly in opposite directions from the substrate-receiving slot defined by the guide portions, to facilitate insertion of a substrate into the slot, and the opposed side walls and end walls include tapered edges to facilitate assembly of the adaptor to the terminal support block.

DETAILED DESCRIPTION

Figure 1:
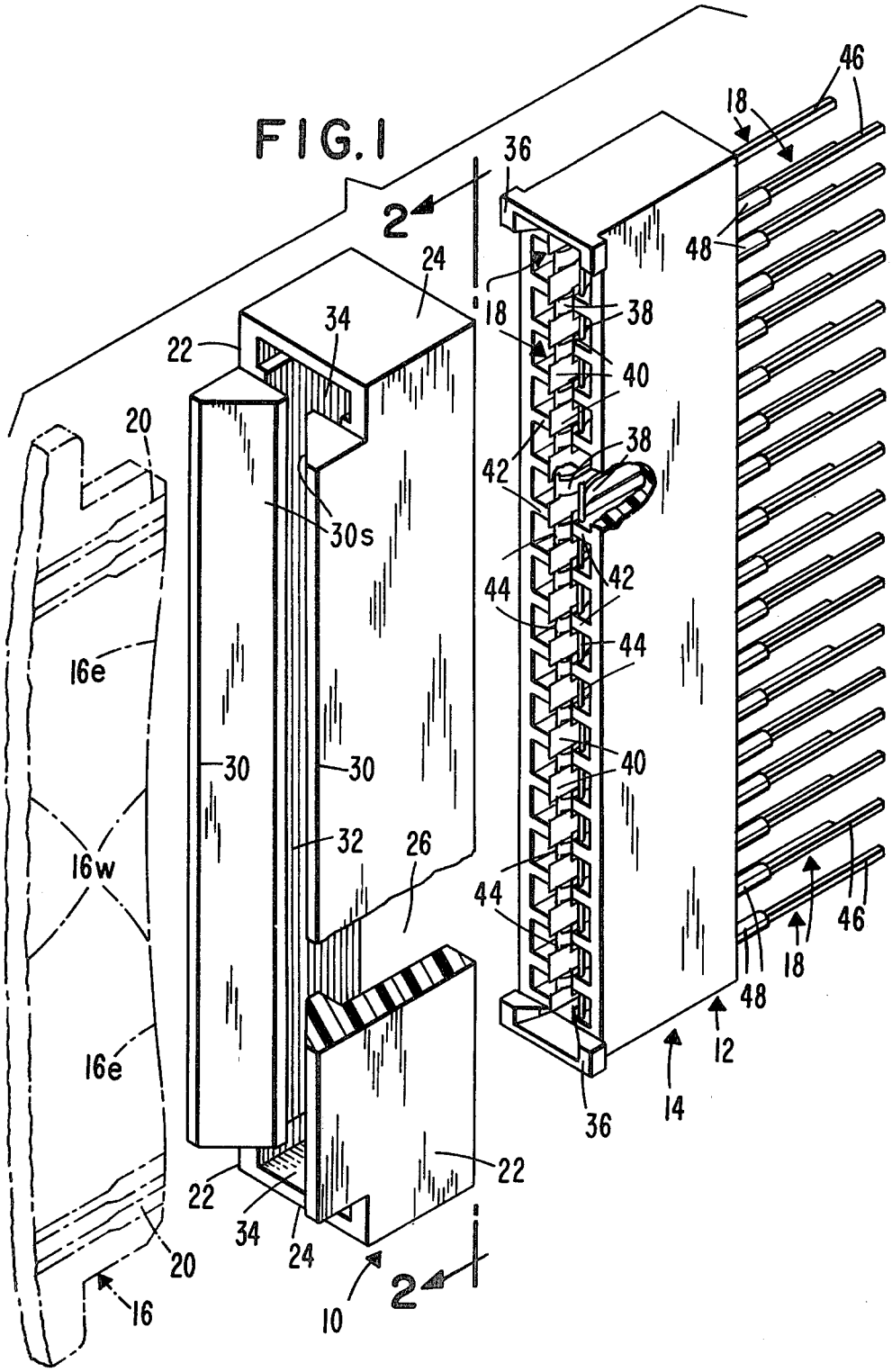
FIG. 1 is an isometric view showing a substrate straightening adaptor in accordance with the invention in conjunction with an associated electrical connector assembly and an associated printed wiring board (substrate), in disassembled relationship.

Referring to FIG. 1, the disclosed embodiment of the invention is directed to a substrate straightening adaptor 10 which can be readily mounted on a terminal support block 12 of an electrical connector assembly 14 of a known type. When a substrate, such as a printed wiring board 16 having a warped portion 16*w*, including a warped leading edge 16*e* as illustrated by the curved line in FIG. 1, then is inserted in the resultant electrical connector device through the adaptor 10 and into the terminal support block 12, the adaptor straightens the warped leading edge of the printed wiring board so that the leading edge enters the support block between two rows of terminals 18 in the support block without breaking the support block and/or bending the terminals. Precious metal contact fingers 20 on opposite sides (only one side shown) of the printed wiring board 16 then engage the terminals 18 to connect the terminals to circuitry (not shown) on the printed wiring board in a known manner.

The adaptor 10 is a molded integral member which may be formed of any suitable plastic. By way of illustration, favorable results have been achieved with a 10% glass-filled polycarbonate.

Figure 3:
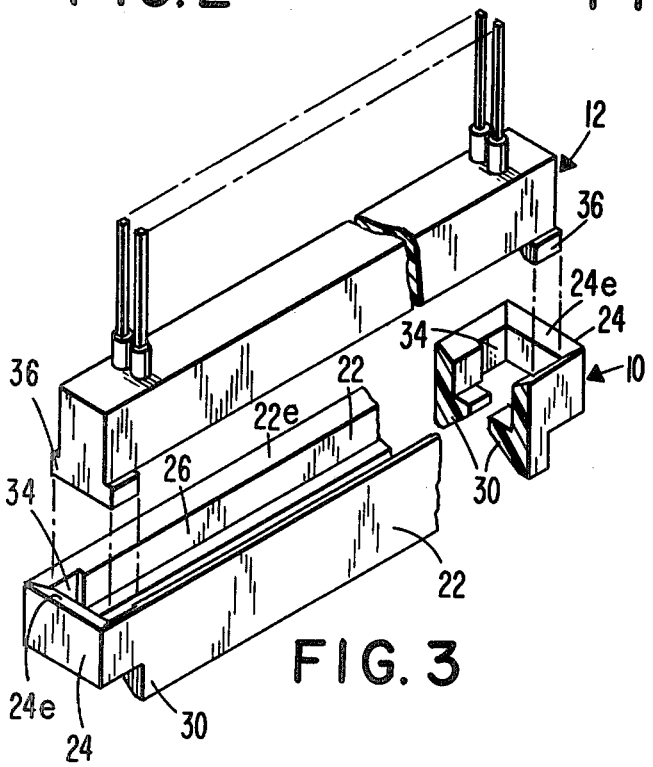
FIG. 3 is another isometric view of the adaptor and the electrical connector assembly in disassembled relationship.
Figure 5:
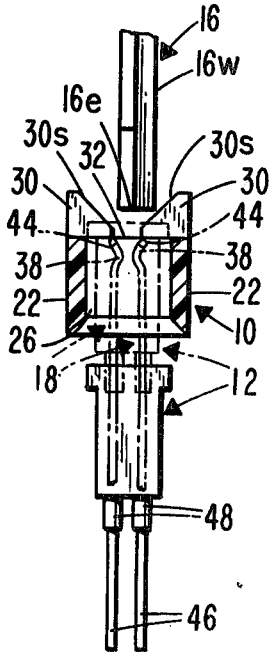
FIG. 5 is another cross-sectional view of the adaptor taken along the line 5—5 of FIG. 2 and illustrating the manner in which the adaptor, the electrical connector assembly and the printed wiring board are assembled together.

The molded adaptor 10 includes a pair of opposed resilient side walls 22 and a pair of opposed end walls 24 which are integrally interconnected to define an elongated essentially rectangular first slot 26 for receiving outer wall portions of the terminal support block 12, as shown in FIG. 5. As is best shown in FIG. 3, the side walls 22 and the end walls 24 of the adaptor 10 include inwardly tapered edge surfaces 22*e* and 24*e*, respectively, to facilitate assembly of the adaptor to the terminal support block 12.

Guide portions 30 of the adaptor 10 project inwardly in opposed spaced relationship from the opposed side walls 22 of the adaptor to define an elongated essentially rectangular substrate-receiving second slot 32 which is narrower than the rectangular first slot 26 defined by the side walls and the end walls 24. The guide portions 30 include inclined surfaces 30*s* (FIGS. 1 and 5) which are tapered outwardly in opposite directions from the substrate-receiving slot 32 defined by the guide portions to facilitate insertion of the printed wiring board 16 into the slot. When the adaptor 10 is assembled to the terminal support block 12, the guide portions 30 overlie portions of the support block and portions of the terminals 18 in protective relationship as is illustrated in FIG. 5, with the slot 32 in alignment with the space between the rows of the terminals. The guide portions 30, which extend essentially the entire length of the adaptor 10, terminate adjacent slots 34 formed in the adaptor at the opposite ends thereof and which receive guide portions 36 of the terminal support block 12 for receiving and guiding side edges of the printed wiring board 16 into the support block.

Figure 2:
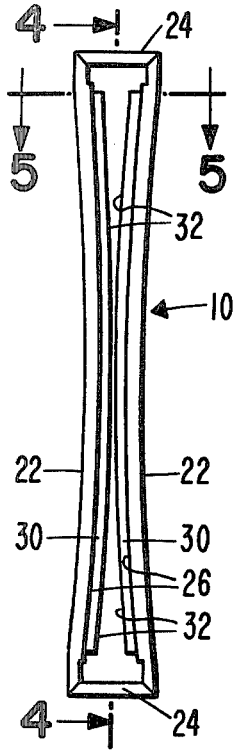
FIG. 2 is an elevational view of the adaptor as seen in the direction of the arrows 2—2 in FIG. 1.
Figure 4:
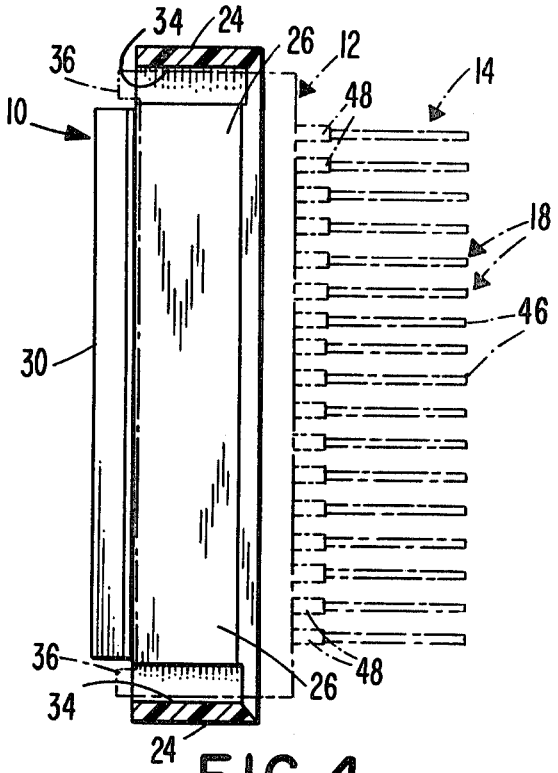
FIG. 4 is a cross-sectional view of the adaptor taken along the line 4—4 of FIG. 2 and illustrating the manner in which the adaptor is assembled to the electrical connector assembly (shown in phantom)

As is illustrated in FIG. 2, the initial spacing of the opposed resilient side walls 22 of the molded adaptor 10 intermediate their ends, prior to assembly of the adaptor to the terminal support block 12, is less than the spacing between the side walls at their junctions with the end walls 24. As a result, the rectangular first slot 26 defined by the side walls 22 and the end walls 24 also is initially narrower intermediate its ends than at its opposite ends. Thus, the adaptor 10 can readily be slipped onto the terminal support block 12, and the resilient side walls 22 then snugly grip the outer wall portions of the support block with a friction fit and without the need for any auxiliary interconnecting mechanism (e.g., latches or tabs) on the adaptor or the support block. In this connection, it has been found that the narrowing of the rectangular first slot 26 can be achieved by initially forming the slot with a true rectangular configuration during molding of the adaptor 10. Then, as the molded adaptor 10 cools, the elongated side walls 22, being supported at their ends by the end walls 24 but unsupported intermediate their ends, shrink toward one another intermediate their ends to produce the narrowing adaptor construction as shown in FIG. 2.

The terminal support block 12 (FIGS. 1 and 3–5) also may be a molded integral member of a suitable plastic insulating material, such as a 30% glass-filled phenolic. The terminals 18 are mounted in the terminal support block 12 with bowed contact blade portions 38 (FIGS. 1 and 5) of the terminals disposed in respective slots defined by rows of thin spaced fins 40 (FIG. 1). The fins 40 are integrally formed on inner ends of respective small spaced ribs 42 (FIG. 1) which project inwardly from opposite sides of the terminal support block 12. The left-hand ends of the terminals 18, as viewed in FIG. 1, include laterally projecting arms 44 which engage behind the fins 40 so that the fins retain the contact blade portions 38 in opposed spaced relationship in the terminal support block 12.

At their other ends the terminals 18 include stem portions 46 of square cross section on which electrical conductor wires (not shown) may be wrapped in a known manner. The stems 46 project from the terminal support block 12 through respective cylindrical extensions 48 of the support block for this purpose. The stems 46 also are received through the cylindrical extensions 48 with a force fit to retain the terminals 18 in the terminal support block 12. Similarly, in use the terminal support block 12 is mounted on an apparatus support plate (not shown), such as a backplane wiring panel, by inserting the stems 46 of the terminals 18 through respective apertures in the support plate and then force-fitting the cylindrical extensions 48 of the support block into the apertures of the support plate.

INDUSTRIAL APPLICATION

In summary, the disclosed adaptor 10 can be mounted on the terminal support block 12 of the electrical connector assembly 14 to provide an electrical connector device in which the adaptor straightens the warped leading edge 16*e* (FIG. 1) of the printed wiring board 16 as the warped leading edge is inserted into the support block for engagement of the contact fingers 20 on the printed wiring board with the contact blade portions 38 of the terminals 18 in the support block. More specifically, when the adaptor 10 has been assembled to the terminal support block 12, the guide portions 30 of the adaptor overlie portions (e.g., the fins 40 and the ribs 42) of the support block and portions (e.g., the arms 44) of the terminals 18 in protective relationship as illustrated in FIG. 5, with the slot 32 defined by the guide portions in alignment with the space between the terminal contact blade portions 38. Thus, as the printed wiring board 16 is inserted into the slot 32 defined by the guide portions 30, the guide portions straighten the warped leading edge 16*e* (FIG. 1) of the board and guide the board into position between the opposed contact blade portions 38 without breakage of the terminal support block 12 and/or bending of the terminals 18.

Further, as a result of the resilient side walls 22 of the adaptor 10 initially being of reduced spacing intermediate their ends as shown in FIG. 2, the adaptor readily can be assembled to the terminal support block 12 with a friction fit and without the need for any auxiliary interconnecting mechanism (e.g., latches or tabs) on the adaptor and/or the block. Thus, the adaptor 10 is particularly useful where the terminal support block 12 already has been assembled in associated electrical apparatus, as for example communications transmission equipment or PBX equipment, in the field.

What is claimed is:

1. A substrate straightening adaptor of molded integral plastic construction which is readily mountable on an electrical connector assembly and which is readily removable from the electrical connector assembly, without the use of an auxiliary connecting mechanism, which comprises:

a pair of opposed side walls and a pair of opposed end walls interconnected to define an elongated essentially rectangular first slot for receiving outer wall portions of a terminal support block in the slot, the opposed side walls being resilient and the spacing between the opposed side walls intermediate their ends being narrower than the spacing between the side walls at junctions of the side walls with the end walls, so that the side walls produce a friction fit when assembled with the terminal support block on opposite sides of the outer wall portions thereof; and guide portions projecting inwardly in opposed spaced relationship from respective ones of the opposed side walls to define an elongated essentially rectangular substrate-receiving second slot which is narrower than the first slot, the guide portions including surfaces which are tapered outwardly in opposite directions from the substrate-receiving slot defined by the guide portions, to facilitate insertion of the substrate into the slot, the guide portions also overlying at least portions of the terminal support block in protective relationship when the adaptor is assembled to the terminal support block, and the guide portions acting to straighten a warped leading edge of the substrate as the substrate leading edge is inserted through the narrower second slot into the terminal support block.

2. An electrical connector device, which comprises:

a terminal support block of electrically insulating material having a plurality of electrical terminals mounted therein;

a substrate straightening adaptor of molded integral plastic construction mounted on the terminal support block, the substrate straightening adaptor being readily mountable on the terminal support block and being readily removable from the terminal support block, without the use of an auxiliary connecting mechanism, the substrate straightening adaptor including a pair of opposed side walls and a pair of opposed end walls interconnected to define an elongated essentially rectangular first slot in which outer wall portions of the terminal support block are received, the opposed side walls of the substrate straightening adaptor being disposed on opposite sides of the outer wall portions of the terminal support block, being resilient, and gripping the outer wall portions of the terminal support block therebetween with a friction fit; and the substrate straightening adaptor further including guide portions projecting inwardly from the side walls of the adaptor in opposed spaced relationship to define an elongated essentially rectangular substrate-receiving second slot which is narrower than the first slot, the guide portions including surfaces which are tapered outwardly in opposite directions from the substrate-receiving slot defined by the guide portions, to facilitate insertion of a substrate into the slot, the guide portions also overlying at least portions of the terminal support block and portions of the terminals in protective relationship, and the guide portions acting to straighten a warped leading edge of a substrate as the substrate leading edge is inserted through the narrower second slot into the terminal support block.

* * * * *